US007043814B2

(12) United States Patent
Hollingsworth et al.

(10) Patent No.: US 7,043,814 B2
(45) **Date of Patent: *May 16, 2006**

(54) METHOD FOR ALIGNING TUBULARS

(75) Inventors: Jimmy Lawrence Hollingsworth, Langenhagen (DE); Bernd Reinholdt, Hannover-Bothfeld (DE)

(73) Assignee: Weatherford/Lamb, Inc., Houston, TX (US)

( * ) Notice: Subject to any disclaimer, the term of this patent is extended or adjusted under 35 U.S.C. 154(b) by 348 days.

This patent is subject to a terminal disclaimer.

(21) Appl. No.: 10/611,565

(22) Filed: Jul. 1, 2003

(65) Prior Publication Data

US 2004/0035587 A1 Feb. 26, 2004

Related U.S. Application Data

(63) Continuation of application No. 09/486,901, filed as application No. PCT/GB98/02582 on Sep. 2, 1998, now Pat. No. 6,591,471.

(30) Foreign Application Priority Data

Sep. 2, 1997 (GB) ..... 9718543

(51) Int. Cl.
*B23P 19/00* (2006.01)

(52) U.S. Cl. ..... 29/407.09; 29/407.1; 29/709; 166/85.1

(58) Field of Classification Search ..... 29/407.01, 29/407.05, 407.09, 407.1, 709, 712, 714, 29/721, 281.1, 281.5; 166/77.53, 85.1; 175/256; 81/57.15, 57.16

See application file for complete search history.

(56) References Cited

U.S. PATENT DOCUMENTS

| | | | | |
|---|---|---|---|---|
| 2,668,689 | A | 2/1954 | Cormany | 255/35 |
| 2,692,059 | A | 10/1954 | Bolling, Jr. | 214/2.5 |
| 3,392,609 | A | 7/1968 | Bartos | 81/57 |
| 3,518,903 | A | 7/1970 | Ham et al. | 81/57.16 |
| 3,838,613 | A | 10/1974 | Wilms | 81/57.34 |
| 3,840,128 | A | 10/1974 | Swoboda, Jr. et al. | 214/1 BD |
| 3,881,375 | A | 5/1975 | Kelly | 81/57.35 |
| 3,885,679 | A | 5/1975 | Swoboda, Jr. et al. | 214/1 BD |
| 3,980,143 | A | 9/1976 | Swartz et al. | 166/77.5 |
| 4,077,525 | A | 3/1978 | Callegari et al. | 214/2.5 |
| 4,194,383 | A | 3/1980 | Huzyak | 72/245 |
| 4,227,197 | A | 10/1980 | Nimmo et al. | 343/878 |
| 4,274,777 | A | 6/1981 | Scaggs | 414/22 |
| 4,277,197 | A | 7/1981 | Bingham | 403/104 |
| 4,440,220 | A | 4/1984 | McArthur | 166/85 |

(Continued)

FOREIGN PATENT DOCUMENTS

| | | |
|---|---|---|
| FR | 2 053 088 | 10/1973 |

(Continued)

*Primary Examiner*—Marc Jimenez
*Assistant Examiner*—Jermie E Cozart
(74) *Attorney, Agent, or Firm*—Patterson & Sheridan, LLP

(57) ABSTRACT

An apparatus is provided with position sensors. When the apparatus has moved one tubular into alignment with another tubular a button on a remote control console is pressed to memorize the position. After the next tubular has been gripped by the apparatus a "recall" button is pressed and the apparatus automatically moves the next tubular to the memorized position. This saves vital seconds in joining tubulars and also reduces the likelihood of threads being damaged due to misalignment of the tubulars.

17 Claims, 2 Drawing Sheets

U.S. PATENT DOCUMENTS

| | | | | |
|---|---|---|---|---|
| 4,604,724 | A | 8/1986 | Shaginian et al. | 166/77.5 |
| 4,652,195 | A | 3/1987 | McArthur | 414/22 |
| 4,681,158 | A | 7/1987 | Pennison | 166/77.5 |
| 4,686,873 | A | 8/1987 | Lang et al. | 81/57.35 |
| 4,691,587 | A | 9/1987 | Farrand et al. | 74/493 |
| 4,725,179 | A | 2/1988 | Woolslayer et al. | 414/22 |
| 4,832,552 | A | 5/1989 | Skelly | 414/22.54 |
| 4,843,945 | A | 7/1989 | Dinsdale | 81/57.34 |
| 4,921,386 | A | 5/1990 | McArthur | 414/22.51 |
| 5,049,020 | A | 9/1991 | McArthur | 414/22.51 |
| 5,060,542 | A | 10/1991 | Hauk | 81/57.34 |
| 5,176,518 | A | 1/1993 | Hordijk et al. | 434/37 |
| 5,294,228 | A | 3/1994 | Willis et al. | 414/22.55 |
| 5,354,150 | A | 10/1994 | Canales | 405/154 |
| 5,368,113 | A | 11/1994 | Schulze-Beckinghausen | 175/162 |
| 5,386,746 | A | 2/1995 | Hauk | 81/57.34 |
| 5,661,888 | A | 9/1997 | Hanslik | 29/407.02 |
| 5,667,026 | A | 9/1997 | Lorenz et al. | 175/162 |
| 5,711,382 | A | 1/1998 | Hansen et al. | 175/52 |
| 5,907,664 | A | 5/1999 | Wang et al. | 395/86 |
| 5,931,231 | A | 8/1999 | Mock | 166/377 |
| 6,591,471 | B1 * | 7/2003 | Hollingsworth et al. | 29/407.09 |

FOREIGN PATENT DOCUMENTS

| | | |
|---|---|---|
| GB | 1 469 661 | 7/1974 |
| GB | 2 201 912 | 9/1988 |
| WO | WO 90/06418 | 6/1990 |
| WO | WO 92/18743 | 10/1992 |
| WO | WO 95/10686 | 4/1995 |

* cited by examiner

METHOD FOR ALIGNING TUBULARS

CROSS-REFERENCE TO RELATED APPLICATIONS

This application is a continuation of U.S. patent application Ser. No. 09/486,901, filed on May 19, 2001, now U.S. Pat. No. 6,591,471, which is the National Stage of International Application No. PCT/GB98/02582, filed on Sep. 2, 1998, and published under PCT Article 21(2) in English. The aforementioned related patent applications are herein incorporated by reference in their entirety.

BACKGROUND OF THE INVENTION

1. Field of the Invention

This invention relates to a method and apparatus for aligning tubulars.

2. Description of the Related Art

During the construction, repair and maintenance of oil and gas wells it is necessary to connect a plurality of tubulars. Conventionally this is achieved via screwed connections.

In order to screw the tubulars together it is usual to hold a lower tubular having an upwardly facing socket in slips in the rig floor. The downwardly extending pin of the next tubular is then aligned with the socket. The tubular is then lowered into position and the upper tubular rotated to the desired torque to make the connection.

It is important that the pin should be correctly aligned with the socket prior to lowering the upper tubular since, if this is not the case, the tubular being lowered can damage the thread of the socket which can prevent satisfactory connection.

One known apparatus for aligning tubulars comprises a positioning head which is mounted on a telescopic arm which can be hydraulically extended and retracted and pivoted in a horizontal plane to position the tubular.

This apparatus is actuated remotely by a skilled operator who has a control panel with a joystick. This apparatus is very satisfactory. However, time is critical in the oil and gas industry and even a few seconds saved in each connecting operation can amount to a very significant overall cost saving.

SUMMARY OF THE INVENTION

With this in mind the present invention provides a method for aligning tubulars, which method comprises the steps of:

a) securing a lower tubular in slips;
b) aligning an upper tubular with said lower tubular with a remotely actuable apparatus;
c) memorising the position of said stabbing guide when said upper tubular is aligned with said lower tubular;
d) connecting said upper tubular and said lower tubular;
e) releasing said slips;
f) lowering said upper tubular and said lower tubular;
g) securing said upper tubular in said slips;
h) gripping a tubular to be connected to said upper tubular in said apparatus;
i) causing said apparatus to move said tubular to said memorized position;
j) adjusting the position of said tubular, if necessary; and
k) connecting said tubular to said upper tubular.

The ability to automatically bring a tubular to its previous optimum position can save seconds on making each connection. Furthermore, it is not unknown for a tired operator to lower a tubular inappropriately with damage resulting to both the pin of the tubular being lowered and the socket of the tubular in the slips. The present invention reduces the probability of this happening with true tubulars where the alignment positions of each tubular will be approximately the same.

Whilst new tubulars are relatively straight this is often not the case for old and rental tubulars which may have been used on multiple occasions and rethreaded and/or shortened due to previous damage. It will be appreciated that although the position of the socket of the tubular in the slips may be reasonably constant the position of the apparatus may have to be varied significantly to ensure alignment of the pin and socket. In these cases the method of the invention is less advantageous although it does provide a first approximation to moving the tubular to the desired position.

Step (c) may be carried out before step (d) or after step (d). Furthermore, the threads of the upper tubular and the lower tubular may be partially made up before step (c) and then fully made up after step (c), i.e. step (c) may be carried out part way through step (d).

Preferably, the memorized position can be adjusted where desired. This may be appropriate if the initial position was memorized using a tubular which was not true.

The present invention also provides an apparatus for aligning tubulars, which apparatus comprises a remotely controllable head adapted to guide a tubular, characterised in that said apparatus is provided with sensing means responsive to the position of said head, means to memorise a position of said head, and means operative to return said head to said operative position.

Preferably, said apparatus comprises a telescopic arm which supports said head.

Advantageously, said sensing means comprises a linear transducer which is associated with said telescopic arm.

Preferably, said linear transducer forms part of a piston-and-cylinder which is used to extend and retract said telescopic arm.

Advantageously, said telescopic arm is mounted on a rotor which is pivotally mounted on a base.

Preferably, said rotor is pivotable by expansion and retraction of a piston-and-cylinder assembly mounted on said base.

Advantageously, said sensing means comprises a linear transducer which is a associated with said piston-and-cylinder assembly.

Preferably, said linear transducer forms part of said piston-and-cylinder assembly.

Advantageously, said telescopic arm is movable between an operative position in which it is generally horizontal and an inoperative position in which it extends upwardly, preferably vertically.

Preferably, said apparatus further comprises a remote control console having a "memory" button which, when actuated, will memorise the position of said head and a "recall" button which, when actuated, will return said head to its memorized position.

BRIEF DESCRIPTION OF THE DRAWINGS

For a better understanding of the present invention reference will now be made, by way of example, to the accompanying drawings, in which.

DETAILED DESCRIPTION

Figure 1:
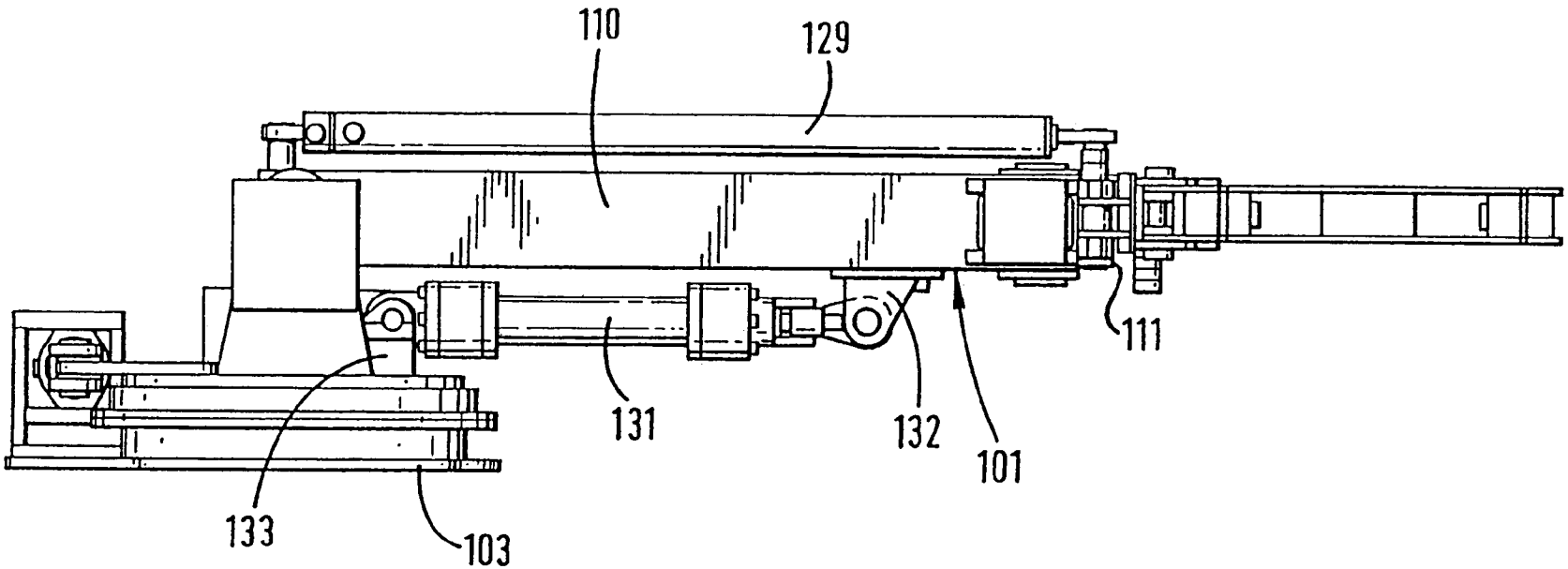
FIG. 1 is a side elevation, with part cut-away, of one embodiment of an apparatus in accordance with the present invention.

Referring to the drawings, there is shown a apparatus for aligning tubulars which is generally identified by reference numeral 101. The apparatus 101 comprises a base 103 which can be conveniently be bolted to a derrick where required.

A rotor 104 is rotatably mounted on said base 103 and can be pivoted with respect to the base 103 by extension and retraction of the piston 105 of a piston-and-cylinder assembly 106 which is mounted fast on the base 103.

Figure 2:
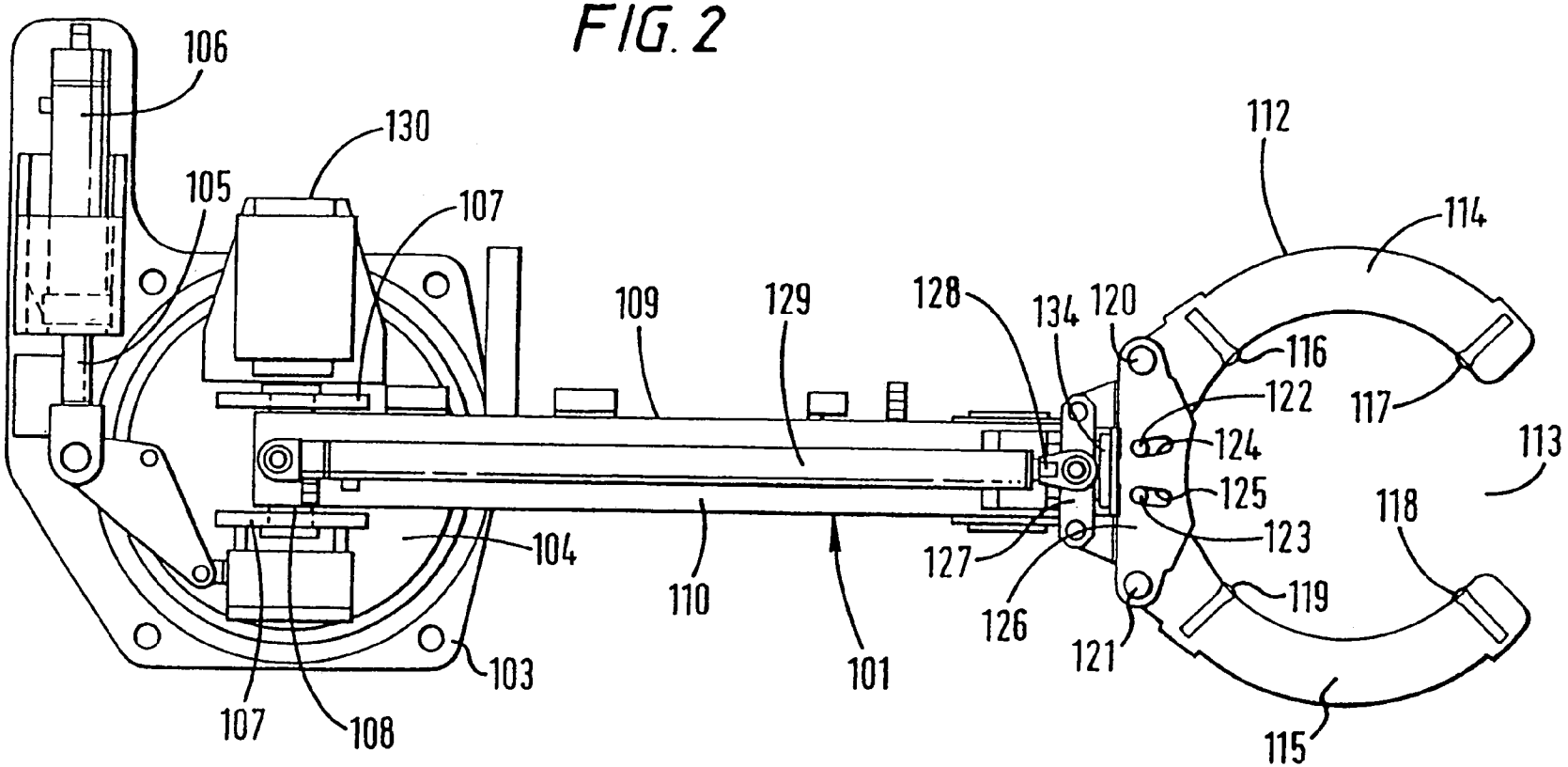
FIG. 2 is a plan view of the apparatus shown in FIG. 1.

Two ears 107 extend upwardly from the rotor 104 and support a pivot pin 108 on which is mounted a telescopic arm 109. The telescopic arm 109 comprises a first box section 110 and a second box section 111 which is slidably mounted in the first box section 110. A head 112 is mounted on the end of the second box section 111 and can be opened to allow the entry of a tubular into opening 113. The head 112 comprises two arms 114, 115 each of which is provided with two centering devices 116, 117, 118, 119 which can be moved radially inwardly and outwardly according to the diameter of the tubular to be accommodated. As can be better seen in FIG. 2, each arm 114, 115 is pivoted on a respective pin 120, 121 and is provided with a respective pin 122, 123 which can travel within respective arcuate slots 124, 125 in a transverse member 126.

The arms 114, 115 can be opened and closed by a small hydraulic actuator 134 disposed beneath the transverse member 126.

The transverse member 126 is connected to a crossmember 127 which is connected to the piston 128 of a hydraulic piston-and-cylinder assembly 129, the other end of which is connected to the first box section 110 over the rotational axis of the rotor 104.

A valve assembly 130 is mounted on the base 103 and is operable from a remote console to direct hydraulic fluid to and from the piston-and-cylinder assembly 106, the piston-and-cylinder assembly 129, the hydraulic actuator 134 for opening and closing the arms 114, 115, and a piston-and-cylinder assembly 131 which acts between a fitting 132 on the first box section 110 and a fitting 133 on the rotor 104. Extension of the piston-and-cylinder assembly 131 displaces the telescopic arm 109 into an inoperative, upwardly extending position, whilst contraction of the piston-and-cylinder assembly 131 moves the telescopic arm 109 to its operative, horizontal, position.

In use, the valve assembly 130 is controlled from a remote console which is provided with a joystick which is spring biased to a central (neutral) position. When the operator displaces the joystick the valve assembly 130 controls the flow of hydraulic fluid to the appropriate piston-and-cylinder assemblies. As soon as the joystick is released the head 112 stops in the position which it has obtained.

The description thus far relates to Applicants existing apparatus.

The present invention differs from the aforedescribed apparatus in that the apparatus 101 includes sensing devices for sensing the position of the head 112. In particular, a linear transducer, for example as sold by Rota Engineering Limited of Bury, Manchester, England, is incorporated in both the piston-and-cylinder assembly 129 and the piston-and-cylinder assembly 106. The linear transducers provide a signal indicative of the extension of both the respective piston-and-cylinder assemblies 106, 129 which is transmitted to the operator's console.

At the commencement of a running operation the telescopic arm 109 is lowered into a horizontal position by contracting piston-and-cylinder assembly 131. The arms 114 and 115 are then opened and the head 112 maneuvered so that the arms 114 and 115 lie around the tubular to be positioned. The arms 114 and 115 are then closed.

The tubular is then maneuvered into position above and in alignment with a lower tubular held in slips. The tubular is then lowered so that the pin enters the socket and the joint is then made up in the usual manner. When the tubular is in this position the operator presses a button marked "memorise" on his console.

After the slips have been released the tubulars are lowered down the borehole and the slips re-set. The next tubular is then in the proximity of the well centre, either being suspended from an elevator or ready for collection from a magazine mounted on the rig floor.

In either event the apparatus 101 is actuated so that the head 112 encircles and grips the new tubular. However, at this time the operator simply presses a button on his console marked "recall". The telescopic arm 109 then immediately moves to the memorized position, this being achieved by a control system (not shown) which displaces the piston-and-cylinder assembly 129 and the piston-and-cylinder assembly 106 until the signals from their respective linear transducers equal the signals memorized. The operator then checks the alignment of the tubulars. If they are correctly aligned the upper tubular can be lowered and the tubulars secured together. If they are not correctly aligned the operator can make the necessary correction by moving the joystick on his console. When the tubulars are correctly aligned the operator can, if he chooses, update the memorized position. However, he may omit this if he believes that the deviation is due to the tubular not being straight.

Various modifications to the embodiment described are envisaged. For example if the tubulars are to be collected from a fixed point the operator's console may have a button for memorising the collection area. This may be particularly appropriate if the tubulars are stored on a rotating magazine alongside the slips. In this case, the collection of the tubular and its positioning ready for stabbing can be very highly automated with only minimal visual verification.

Whereas the position of the head is preferably memorized electronically it could also be memorized mechanically or optically.

The apparatus 101 described is designed so that head 112 merely guides the tubular being stabbed with the weight of the tubular being supported by an elevator or similar device. However, it would be possible to construct the apparatus 101 to take the entire weight of the tubular. In this case it would be desirable to include a device for raising and lowering the tubular to facilitate the stabbing operation and, optionally, modifying the head 112 to allow rotation of the tubular whilst inhibiting vertical movement. Vertical adjustment could conveniently be provided by hydraulic cylinders between the base 103 and the rig floor or the derrick on which the apparatus 101 is mounted.

If desired the centering devices 116, 117, 118 and 119 could be remotely adjustable to accommodate tubulars of different sizes. Such an arrangement might also include sensors to report the positions of the centering devices.

In practice it is known that certain operators appear to have a gift for making successful connections quickly and efficiently. On observing these operators it can be seen that they apply extremely personal complex motions to the upper tubular as it is being inserted into the socket. A second aspect of the present invention contemplates recording these motions via the sensing means and reproducing these motions during a subsequent connecting operation. This procedure may be applied in conjunction with or completely separate and distinct from the method of aligning tubulars herein before described.

While the foregoing is directed to embodiments of the present invention, other and further embodiments of the invention may be devised without departing from the basic scope thereof, and the scope thereof is determined by the claims that follow.

The invention claimed is:

1. A method of aligning a first tubular with a second tubular, comprising:

providing a remotely controllable positioning head;

determining a position of the head, wherein the position of the head would align the first tubular with the second tubular;

memorizing the position of the head; and positioning the first tubular at the memorized position.

2. The method of claim 1, wherein a third tubular is positioned by recalling the memorized position.

3. The method of claim 1, wherein one or more sensing devices are used to determine the position of the head.

4. The method of claim 3, wherein each of the one or more sensing devices comprises a linear transducer.

5. The method of claim 1, wherein a telescopic arm is used to position the head.

6. The method of claim 5, wherein a piston and cylinder assembly is used to extend or retract the telescopic arm.

7. The method of claim 6, wherein a sensing device is used to determine the amount of extension or retraction of the piston and cylinder assembly.

8. The method of claim 1, wherein the position of the head is memorized electronically.

9. The method of claim 1, wherein the position of the head is memorized mechanically.

10. The method of claim 1, wherein the position of the head is memorized optically.

11. The method of claim 1, further comprising adjusting the position of the head.

12. The method of claim 11, further comprising memorizing the new position of the head.

13. A method for aligning a first tubular with a second tubular, comprising:

securing the first tubular in a gripping member;

aligning the second tubular with the first tubular using a remotely actuatable apparatus;

memorizing the position of the remotely actuatable apparatus when the second tubular is aligned with the first tubular;

connecting the second tubular to the first tubular; and releasing the first tubular from the gripping member.

14. The method of claim 13, further comprising:

lowering the first tubular and the second tubular;

securing the second tubular in the gripping member;

gripping a third tubular to be connected to the second tubular using the remotely actuatable apparatus;

moving the remotely actuatable apparatus to position the third tubular at the memorized position; and connecting the third tubular to the second tubular.

15. The method of claim 14, further comprising adjusting the position of the third tubular before connecting to the second tubular.

16. The method of claim 13, wherein connecting the second tubular to the first tubular is performed before memorizing the position of the remotely actuatable apparatus.

17. The method of claim 16, wherein memorizing the position is performed when the second tubular is partially connected to the first tubular.

* * * * *